US006705605B2

(12) United States Patent
Watkiss

(10) Patent No.: US 6,705,605 B2
(45) Date of Patent: Mar. 16, 2004

(54) METHODS OF AND APPARATUS FOR FEEDING SHEETS OF MATERIAL

(75) Inventor: Christopher Robin Watkiss, Biggleswade (GB)

(73) Assignee: Watkiss Automation Limited, Biggleswade (GB)

( * ) Notice: Subject to any disclaimer, the term of this patent is extended or adjusted under 35 U.S.C. 154(b) by 0 days.

(21) Appl. No.: 09/843,871

(22) Filed: Apr. 27, 2001

(65) Prior Publication Data

US 2003/0205861 A1 Nov. 6, 2003

(30) Foreign Application Priority Data

Apr. 29, 2000 (GB) ..... 0010366

(51) Int. Cl.[7] ..... B65H 3/12; B65H 3/56

(52) U.S. Cl. ..... 271/99; 271/104; 271/23; 271/138

(58) Field of Search ..... 271/99, 104, 132, 271/137, 138, 23

(56) References Cited

U.S. PATENT DOCUMENTS

| | | | | |
|---|---|---|---|---|
| 3,193,282 A | 7/1965 | Stewart | ..... | 271/12 |
| 4,270,746 A | 6/1981 | Hamlin | ..... | 271/98 |
| 4,336,929 A | 6/1982 | Hanzlik | ..... | 271/20 |
| 4,462,586 A | 7/1984 | Browne | ..... | 271/94 |
| 5,071,110 A | 12/1991 | Arnone et al. | ..... | 271/104 |
| 5,797,597 A | 8/1998 | Kakuta et al. | ..... | 271/96 |

FOREIGN PATENT DOCUMENTS

| | | |
|---|---|---|
| EP | 0030410 A | 6/1981 |
| EP | 0446889 A | 9/1991 |
| EP | 0459667 A | 12/1991 |
| GB | 2109352 A | 6/1983 |
| GB | 2137178 A | 10/1984 |
| GB | 2138787 | 10/1984 |
| GB | 2214495 | 6/1989 |

*Primary Examiner*—Christopher P. Ellis
*Assistant Examiner*—Mark A. Deuble
(74) *Attorney, Agent, or Firm*—Drinker Biddle & Reath LLP

(57) ABSTRACT

An apparatus for feeding sheets of material, such as paper, sequentially from the bottom of a stack of sheets comprises a suction chamber, a perforated belt movable over the suction chamber, a sheet restraining gate above the downstream end of the suction chamber, and a roller to produce an upward corrugation in the bottom sheet only of the stack. The gap between the bottom of the gate and the belt is profiled to match the corrugation in the bottom sheet to enable the bottom sheet only to pass through. The profile preferably includes a shallow triangular recess in the bottom edge of the gate.

17 Claims, 4 Drawing Sheets

METHODS OF AND APPARATUS FOR FEEDING SHEETS OF MATERIAL

FIELD OF THE INVENTION

This invention relates to methods of and apparatus for feeding sheets of material sequentially from a stack, and is more particularly concerned with the separation and feeding of sheets from the bottom of a stack.

BACKGROUND OF THE INVENTION

Various forms of bottom feeder for stacks of sheet material, such as sheets of paper, are known. These include inter alia U.S. Pat. No. 5,797,597, U.S. Pat. No. 4,336,929, GB2137178A, GB2109352A, EP0459667, EP0446889 and EP0030410. In a number of these prior art machines, the stack of sheets is held in place by a restraining means and one has to adjust the height of the restraining means to define the size of a gap underneath it for the passage of a sheet in dependence upon the thickness of the sheets to be fed. That makes these machines very difficult to set up, as well as requiring readjustment of the restraining means each time that there is a change in the sheets which are to be fed.

SUMMARY OF THE INVENTION

It is an object of the present invention to provide a method of and apparatus for feeding sheets of material sequentially from the bottom of a stack in which the means of adjustment necessary in order to be able to feed sheets of different thickness through the mechanism is extremely simple.

It is a further object of the present invention to provide a bottom feeder which is substantially less costly than top feeders but which is reliable in operation and able to feed sheets of different thickness.

It is yet a further object of the present invention to provide a bottom feeder which will feed very thin paper right up to very thick card with only very simple adjustment being necessary.

In accordance with one aspect of the present invention there is provided an apparatus for feeding sheets of material successively from the bottom of a stack of sheets, comprising means defining a suction chamber, one or more perforated belts moveable over the suction chamber, means defining the position of a stack of sheets above the suction chamber so that the stack is in contact with the belt or belts, restraining means for the sheets of the stack positioned towards the downstream end of the suction chamber and arranged to define a gap between the bottom of the restraining means and the belt or belts, and means to produce an upward corrugation in the bottom sheet only of the stack in advance of the restraining means, wherein the profile of the gap is such as to permit the passage of the corrugated bottom sheet.

In accordance with another aspect of the invention there is provided a method of feeding sheets successively from the bottom of a stack of sheets, which comprises generating suction within a suction chamber, moving a perforated belt or belts around the suction chamber thereby to generate a suction force at the surface of the belt or belts, positioning a stack of sheets above the suction chamber in contact with the upper surface of the belt or belts, restraining the forward movement of the sheets towards the downstream end of the suction chamber by restraining means which defines a profiled gap between itself and the surface of the belt or belts, arranging for corrugation means to produce an upward corrugation in the bottom sheet only of the stack in advance of the restraining means, and generating an intermittent suction effect within the suction chamber, thereby to effect feeding of the corrugated bottom sheet of the stack through said profiled gap.

Preferably, the restraining means comprises a gate positioned towards and above the downstream end of the suction chamber which has the capacity for adjustment relative to the belt or belts but which does not need to be adjusted in accordance with the thickness of the sheets to be fed. The only adjustment which needs to be made to accommodate the feeding of sheets of different thickness is an adjustment of the corrugation means in terms of the amount of distortion it produces in the bottom sheet.

The corrugation means is preferably a roller within a single belt and which is capable of adjustment in a direction perpendicular to the direction of movement of the belt, in order to vary the profile of the belt.

Preferably, the restraining means is provided with a recess in a substantially linear bottom edge thereof, in alignment with the corrugation means. This recess is preferably in the form of a notch whose shape mimics the shape of the bottom sheet distorted by the belt. The combination of such a recess and the aligned corrugator means that just by varying the height of the corrugator and thus the amount of distortion of the belt, sheets of a wide range of thicknesses can be fed from the stack without misfeeds or double-feeds. This avoids the need both for repeated setting of the restraining gate and also for careful re-setting of the gap between the restraining gate and the underlying belt.

Preferably, to assist in the separation of the bottom sheet of the stack, and so that only the bottom sheet is held down against the belt, air is blown continuously at the sides of the stack, towards the bottom sheet.

BRIEF DESCRIPTION OF THE DRAWINGS

In order that the invention may be more fully understood, embodiments of apparatus in accordance with the invention, and their method of operation, will now be described by way of example and with reference to the accompanying drawings. In the drawings.

DESCRIPTION OF THE PREFERRED EMBODIMENT

Figure 3:
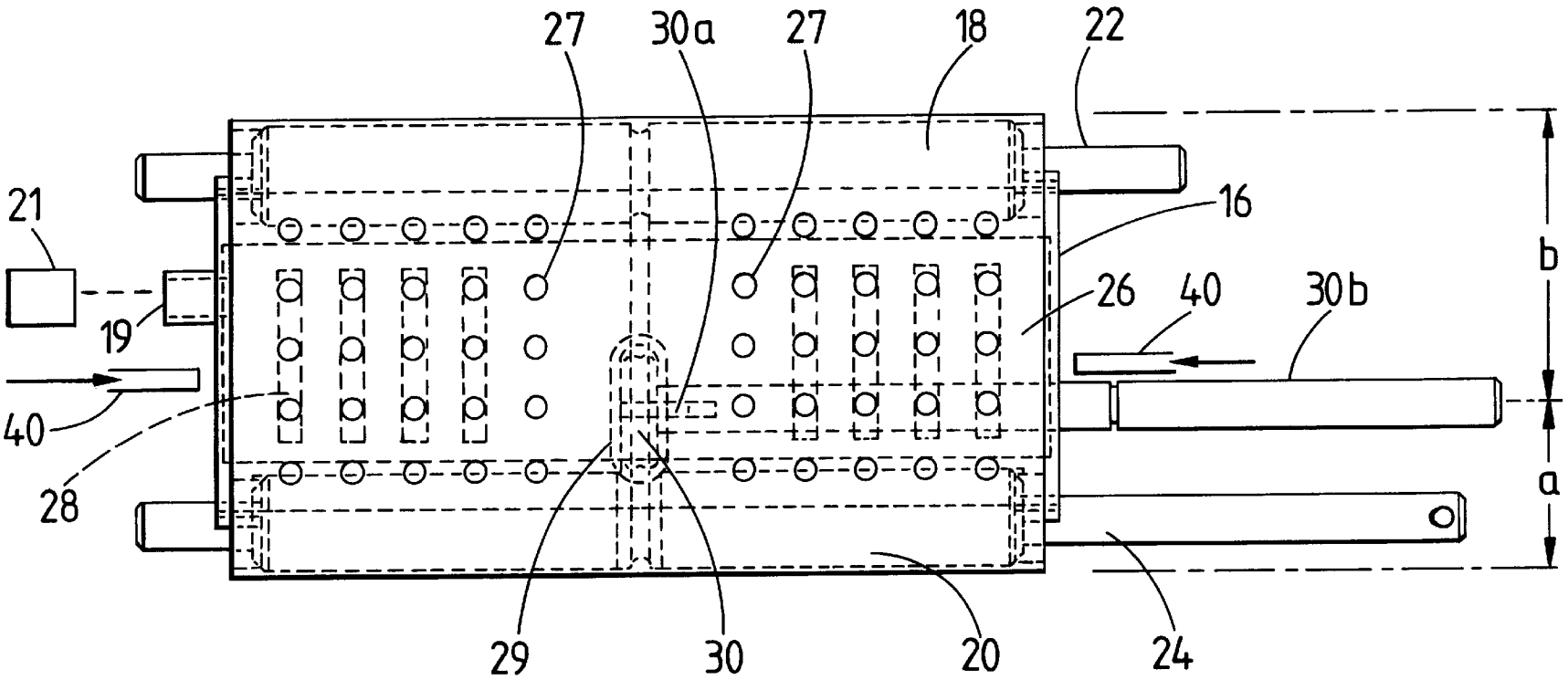
FIG. 3 is a schematic plan view of the feed mechanism shown in FIG. 1.

Referring now to the drawings, there is shown a feed mechanism, indicated generally at 10, for the separation and onward feeding of the bottom sheet of a stack 11 of sheets of material. The feed mechanism comprises a suction chamber 14 which is defined by a housing 16 which has a drivable roller at each end, one roller 18 at the upstream end of the housing and the other roller 20 at the downstream end of the housing. The rollers 18 and 20 are rotationally driven by respective drive shafts 22 and 24. A pipe 19 connects the housing to a source of suction 21. Around the housing 16 and the rollers 18 and 20 and in contact therewith so as to be driven by the rollers is a belt 26 which is provided with rows of parallel equispaced perforations 27 as shown in FIG. 3. The direction of movement of the belt 26 is indicated in FIG.

1 by arrows 25. The housing 16 is provided with a plurality of parallel elongate slots 28 therethrough which are in alignment with the respective rows of perforations 27 in the belt, so that the creation of a suction effect within the suction chamber 14 will produce suction at the surface of the belt at the rows of perforations 27. As shown, there are five rows of perforations on each side of the centreline of the belt, but only the outer four rows on each side overlie the suction slots 28.

Figure 1:
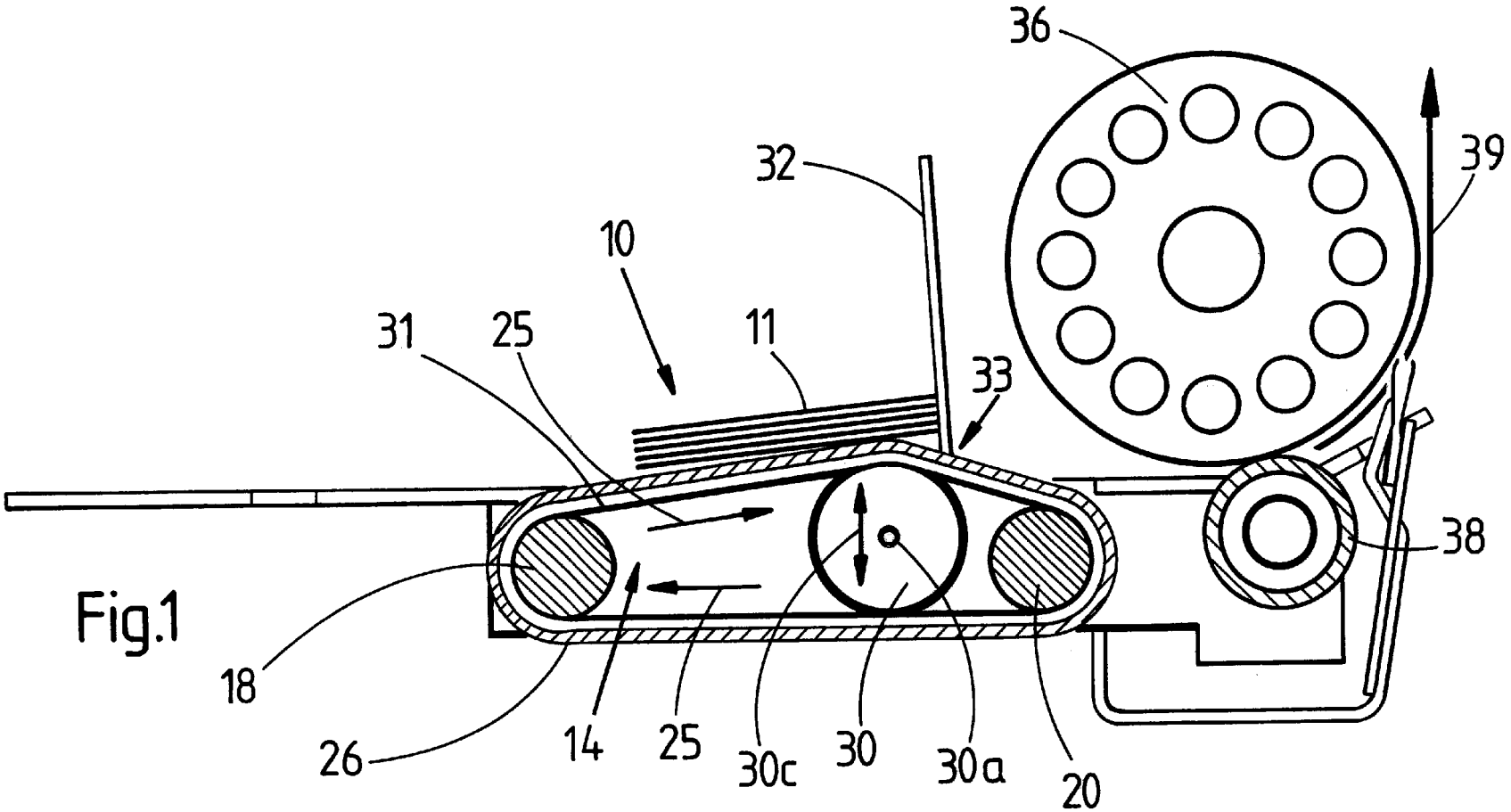
FIG. 1 is a schematic side view of a first embodiment of feed mechanism in accordance with the invention.

The suction chamber housing 16 incorporates a recess 29 in which is mounted a corrugating roller 30, within the confines of the belt 26. The roller 30 is carried on a pin 30*a* which is connected to a rotatable shaft 30*b*. Manually or otherwise, the shaft 30*b* can be rotated, thereby to cause the pin and the roller 30 to rise or fall and the amount of protrusion of the roller 30 above the housing to increase or decrease. This movement is indicated by arrow 30*c* (FIG. 1), the movement being in a direction substantially perpendicular to the direction of movement 25 of the belt 26 as it passes above the roller. An endless tie or cable 31, shown in FIG. 1 but omitted from FIG. 3, links the drive rollers 18 and 20 and the corrugating roller 30, each being grooved as shown, to effect rotation of all three rollers. The purpose of roller 30 is to act as a corrugator, producing a distortion in the centre of the belt towards the downstream end of the upper run of the belt. The amount of protrusion of the roller 30 above the surface of the housing will cause varying amounts of distortion or corrugation of the belt and hence a greater or lesser effect on the central zone of the bottom sheet of the stack 11. The roller 30 is positioned in relation to the upstream/downstream length of the belt approximately one third from the leading edge and two thirds from the trailing edge, as indicated by the dimensions a and b in FIG. 3.

Figure 2:
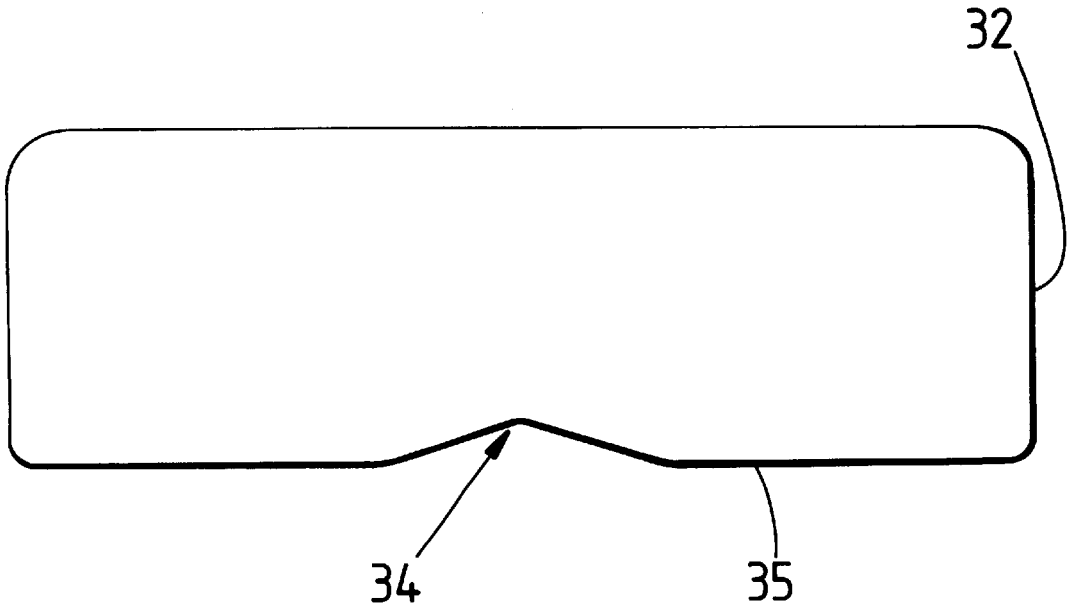
FIG. 2 is a view of the restraining plate or gate in FIG. 1.

Above and towards the downstream end of the upper run of the belt 26, there is provided a substantially vertical restraining plate 32 which extends the full width of the feed mechanism and which defines a gap 33 between the bottom edge of the plate 32 and the underlying belt 26. The restraining plate 32, which acts as a gate, is capable of adjustment movement in a vertical direction to vary the size of the gap 33. As shown in FIG. 2, the restraining plate 32 is generally rectangular with a recess 34 in its otherwise substantially linear bottom edge 35, at the centre, in alignment with the corrugating roller 30. This recess 34 has the general shape of a shallow triangle and substantially mimics the shape of the bottom sheet of the stack 11 when it is distorted by the corrugated belt, so that it will pass therethrough and under the gate. It has been found that the combination of the corrugating roller 30 and the recess 34 enables the feeding of individual sheets through the gap.

Beyond the gap there is provided a pair of nip rollers 36, 38 which are arranged to grip the sheets as they are fed through the gap 33 and to deliver them onwards for further processing, as indicated by arrow 39.

Means are provided to direct jets of air from each side of the feed mechanism towards the bottom sheet of the stack 11 of sheets to assist in its separation from the bottom of the stack. These air jets are indicated schematically at 40 in FIG. 3.

In operation, a stack 11 of sheets is laid on the feed mechanism with the front edges of the sheets in contact with the restraining plate 32. The position of the plate 32 is adjusted to set an appropriate gap 33 and the position of the roller 30 is then adjusted in relation to the housing in order to produce an amount of protrusion of the belt 26 which is appropriate for the particular type, e.g. thickness, density, material, of sheets which are to be fed by the mechanism. Then, air is blown towards the sides of the bottom sheet of the stack through jets 40 and the belt 26 is driven intermittently from drive shafts 22, 24 with the synchronised intermittent generation of suction within the chamber 14. The bottom sheet of the stack 11 is attracted towards and is held down against the belt 26 by the suction, is separated from the remainder of the stack, is corrugated at its centre by the distortion in the belt, and is fed onwards through the gap 33 while the sheets above it are restrained by the plate 32. Only the bottom sheet adapts to the profile of the belt; the other sheets are blocked.

If sheets of a different thickness or a different density or a different material then are to be fed by the mechanism, the only adjustment which is necessary is an adjustment of the height of the roller 30 to vary the amount of distortion of the belt 26, i.e. its profile, so as to be appropriate for the replacement sheets.

Figure 4:
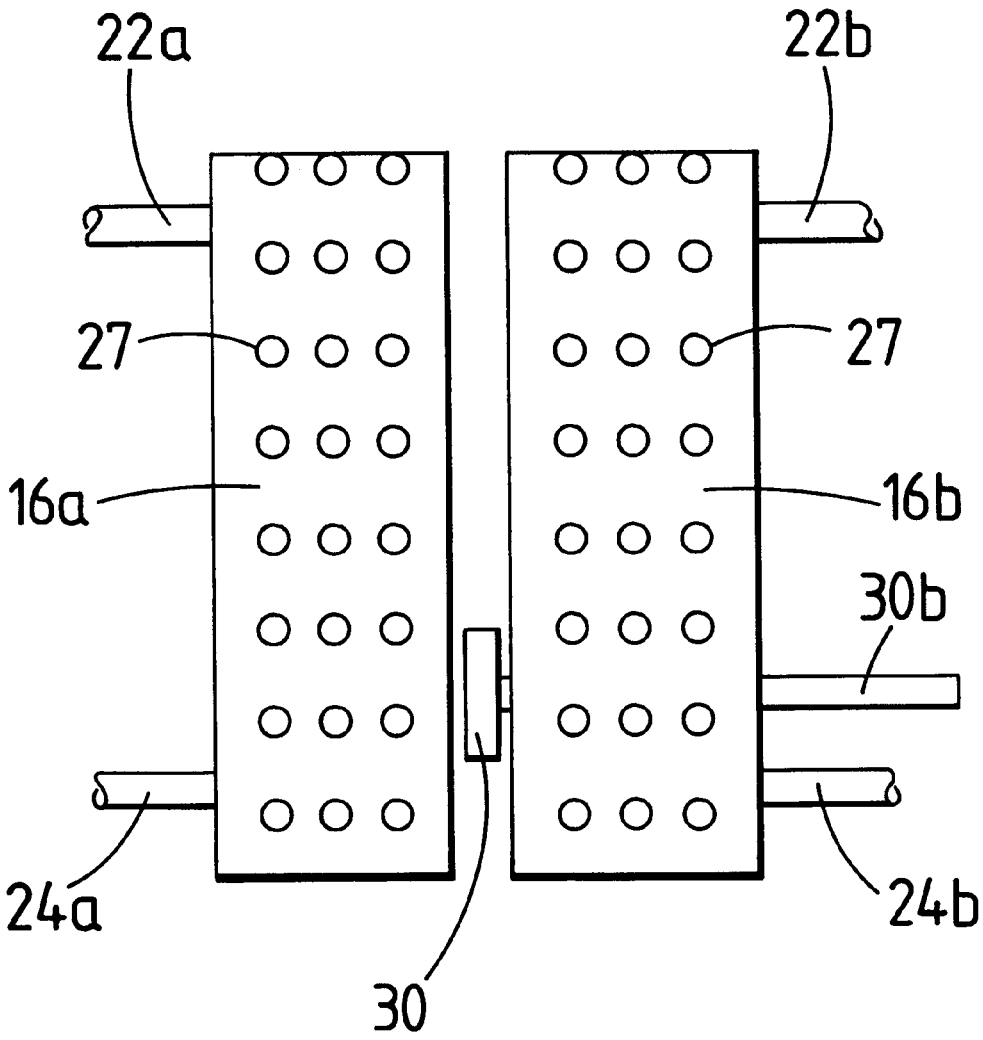
FIG. 4 is a schematic representation of an alternative embodiment, shown in plan view.

Although the feed mechanism has been described with a single belt 26 and with a roller 30 acting against the inside of the belt, which is the preferred arrangement, an alternative arrangement would be to provide two or more separated, parallel belts, arranged symmetrically in relation to the roller 30, and with the roller acting not against a belt but directly against the bottom sheet of the stack,i.e. between two belts. This is shown schematically in FIG. 4. Two perforated belts 16*a*, 16*b* replace the single belt 16, with the corrugating roller 30 set therebetween. The belts are driven by drive shafts 22*a*, 22*b*, 24*a*, 24*b*. The setting of the corrugating roller 30 is adjustable by means of control rod 30*b*.

Also, other forms of corrugator than a simple roller could be used.

The foregoing description of the invention has been given for the purposes of illustration and description. It is not intended to be exhaustive or to limit the invention to the precise form described. Many modifications and variations are possible in the light of the teaching above. It is intended that the scope of the invention be defined by the claims appended hereto.

What is claimed is:

1. Apparatus for feeding sheets of material successively from the bottom of a stack of sheets, comprising means defining a suction chamber, one or more perforated belts moveable over the suction chamber, means defining the position of a stack of sheets above the suction chamber so that the stack is in contact with the belt or belts, restraining means for the sheets of the stack positioned towards and above the downstream end of the suction chamber and arranged to define a gap between the bottom of the restraining means and the belt or belts, and means to produce an upward corrugation in the bottom sheet of the stack in advance of the restraining means, wherein the restraining means comprises a gate provided with a recess in an otherwise substantially linear bottom edge thereof, the recess being in alignment with the corrugation means whereby the gap has a profile such as to permit the passage only of the corrugated bottom sheet, and the corrugation-producing means is capable of adjustment in a direction substantially perpendicular to the direction of movement of the belt in order to vary the extent of the corrugation hi the bottom sheet.

2. Apparatus according to claim 1, wherein the gate is arranged for adjustment relative to the belt or belts.

3. Apparatus according to claim 1, in which the corrugation means comprises a roller between a pair of belts extending parallel to each other.

4. Apparatus according to claim 1, in which the recess is in the form of a notch whose contour mimics the contour of the corrugated bottom sheet.

5. Apparatus according to claim 1, in which the recess has the shape of a shallow triangle.

6. Apparatus according to claim 1, in which the Corrugation means comprises a roller within a single belt.

7. Apparatus according to claim 1, further comprising means for directing air jets towards the sides of the bottom sheet in the stack.

8. A method of feeding sheets successively from the bottom of a stack of sheets, which comprises generating suction within a suction chamber, moving a perforated belt or belts around the suction chamber thereby to generate a suction force at the surface of the belt or belts, positioning a stack of sheets above the suction chamber in contact with the upper surface of the belt or belts, restraining the forward movement of the sheets towards the downstream end of the suction chamber by a restraining means which comprises a gate provided with a recess in an otherwise substantially linear bottom edge thereof to define a profiled gap between itself and the surface of the belt or belts, arranging for corrugation means to produce an upward corrugation in the bottom sheet of the stack in advance of the restraining means, and generating an intermittent suction effect within the suction chamber, the extent of the corrugation in the direction perpendicular to the direction of movement of the belt or belts being adjusted so as to effect feeding only of the corrugated bottom sheet of the stack through said profiled gap and restraint by the restraining means of other sheets of the stack.

9. Apparatus for feeding sheets of material successively from the bottom of a stack of sheets, comprising means defining a suction chamber, one or more perforated belts moveable over the suction chamber, means defining the position of a stack of sheets above the suction chamber so that the stack is in contact with the belt or belts, restraining means for the sheets of the stack positioned towards the downstream end of the suction chamber and arranged to define a gap between the bottom of the restraining means and the belt or belts, and means to produce an upward corrugation in the bottom sheet of the stack in advance of the restraining means, wherein the gap has a profile such as to permit the passage only of the corrugated bottom sheet, the restraining means comprising a gate positioned towards and above the downstream end of the suction chamber and arranged for adjustment relative to the belt or belts, the gate being provided with a recess in an otherwise substantially linear bottom edge thereof, with the recess being in the form of a notch whose contour mimics the contour of the corrugated bottom sheet in alignment with the corrugation means.

10. Apparatus according to claim 9, in which the recess has the shape of a shallow triangle.

11. Apparatus according to claim 9, in which the corrugation means comprises a roller within a single belt and capable of adjustment in a direction substantially perpendicular to the direction of movement of the belt, in order to vary the profile of the belt.

12. Apparatus according to claim 9, in which the corrugation means comprises a roller between a pair of belts extending parallel to each other and capable of adjustment in a direction substantially perpendicular to the direction of movement of the belt, in order to vary the profile of the belt.

13. Apparatus for feeding sheets of material successively from the bottom of a stack of sheets, comprising means defining a suction chamber, one or more perforated belts moveable over the suction chamber, means defining the position of a stack of sheets above the suction chamber so that the stack is in contact with the belt or belts, restraining means for the sheets of the stack positioned towards and above the downstream end of the suction chamber and arranged to define a gap between the bottom of the restraining means and the belt or belts, means to produce an upward corrugation in the bottom sheet of the stack in advance of the restraining means, wherein the restraining means comprises an adjustable gate, the gate being provided with a recess in an otherwise substantially linear bottom edge thereof, the recess being in alignment with the corrugation means, whereby the gap has a profile such as to permit the passage only of the corrugated bottom sheet, the apparatus further comprising means for adjustment of the position of the restraining means relative to the belt or belts so that the extent of the gap in a direction perpendicular to the belt or belts can be preset to provide for feeding of bottom sheets of different predetermined thicknesses.

14. Apparatus according to claim 13, in which the recess is in the form of a notch whose contour mimics the contour of the corrugated bottom sheet.

15. Apparatus according to claim 13, in which the recess has the shape of a shallow triangle.

16. Apparatus according to claim 13, in which the corrugation means comprises a roller within a single belt and capable of adjustment in a direction substantially perpendicular to the direction of movement of the belt, in order to vary the profile of the belt.

17. Apparatus according to claim 13, in which the corrugation means comprises a roller between a pair of belts extending parallel to each other and capable of adjustment in a direction substantially perpendicular to the direction of movement of the belt, in order to vary the profile of the belt.

* * * * *